US008763670B2

(12) United States Patent
Clouse et al.

(10) Patent No.: US 8,763,670 B2
(45) Date of Patent: Jul. 1, 2014

(54) AUTOMATED PEELER

(76) Inventors: Rodney Clouse, Fargo, ND (US); Sulejman Padalo, Fargo, ND (US)

( * ) Notice: Subject to any disclaimer, the term of this patent is extended or adjusted under 35 U.S.C. 154(b) by 295 days.

(21) Appl. No.: 13/428,264

(22) Filed: Mar. 23, 2012

(65) Prior Publication Data

US 2012/0255680 A1 Oct. 11, 2012

Related U.S. Application Data

(60) Provisional application No. 61/473,247, filed on Apr. 8, 2011.

(51) Int. Cl.
*B32B 38/10* (2006.01)
*B32B 37/22* (2006.01)

(52) U.S. Cl.
USPC ..... 156/560; 156/71; 156/249; 156/715; 156/759

(58) Field of Classification Search
CPC ..... E01F 9/042; E01F 9/044; E01F 9/06; E01C 23/18
USPC ..... 156/71, 249, 539, 560, 715, 759
See application file for complete search history.

(56) References Cited

U.S. PATENT DOCUMENTS

| | | | | |
|---|---|---|---|---|
| 3,864,052 | A * | 2/1975 | Blomberg | 404/94 |
| 4,089,730 | A * | 5/1978 | Mahn | 156/541 |
| 4,623,280 | A * | 11/1986 | Stenemann | 404/94 |
| 4,936,485 | A * | 6/1990 | Downing | 221/297 |
| 5,853,263 | A * | 12/1998 | Green | 404/94 |
| 6,709,193 | B1 * | 3/2004 | Rogers et al. | 404/94 |
| 6,896,444 | B2 * | 5/2005 | Orthaus et al. | 404/12 |

* cited by examiner

*Primary Examiner* — Mark A Osele
(74) *Attorney, Agent, or Firm* — Daniel A. Rosenberg; Briggs and Morgan, P.A.

(57) ABSTRACT

A method and apparatus for application of pavement markers to a roadway or surface that provides for mechanical separation of paper backer from the adhesive surface of the markers. A pair of motor driven drums, having two barb bands, drives the markers through the apparatus and grasps and separates the paper backer from the markers.

18 Claims, 9 Drawing Sheets

AUTOMATED PEELER

RELATED APPLICATIONS

The present application claim priority to and incorporates by reference U.S. Provisional Patent Application No. 61/473,247 of the same title filed on Apr. 8, 2011.

FIELD OF THE INVENTION

This invention relates to an apparatus and method of applying pavement markers to roadway surfaces. In particular, the invention relates to an apparatus and method to automate the removal of a paper protective backing from the pavement marker in association with application of the pavement marker to a roadway. Of course, a person of ordinary skill in the art will understand that the invention is not necessarily so limited.

BACKGROUND OF THE INVENTION

Pavement markers 10, such as those shown in FIG. 1, are well known in the art, wherein such markers 10 are affixed to roadways and pavement along centerlines, edge lines, lane dividers, or guardrails. Pavement markers 10 are also used as temporary lane dividers during construction projects, detours, or prior to permanent marking of newly paved roadways.

Generally, thousands or tens of thousands of pavement markers 10 are applied to the roadway at a time, where the markers 10 are regularly spaced apart over a distance of many miles. The markers 10 are often applied in two rows, as shown in FIG. 1, with each row straddling opposite sides of a divider line such as the centerline. This doubles the number of markers 10 that need to be applied relative to a given project.

Thus, pavement markers 10 are purchased in large quantities, but require individual human application. To apply a pavement marker 10 to the roadway requires removing a protective wax paper backer 12, as shown in FIG. 2. The paper backer 12 is applied to the marker 10 at the time of manufacture to protect a butyl adhesive layer on the back (or pavement side) of the marker 10. The paper backer 12 protects the adhesive surface, and prevents the markers 10 from sticking to each other during transportation and prior to application to a roadway. The paper backer 12 must be removed at the time of application, at which point the butyl bonds with the roadway or application surface to rigidly secure the marker 10 to the surface.

Application of the markers 10 to the roadway, or other surface, is a manually intensive procedure. Typically, the task is performed by a group of at least five workers. The workers operate on a trailer pulled behind a towing vehicle, and the workers apply the markers 10 to the roadway surface as the trailer is towed along the road.

One of the more difficult and time consuming steps in the process is removing the backing paper 12 from the markers 10 at the time of application. Removal requires prying up an edge of the paper, peeling the paper from the marker 10, and dispensing of the paper backer 12 all by individual workers. The task, while not complicated, is time consuming and requires a fair amount of dexterity. For example, the process cannot typically be performed while wearing gloves, and given the roughness of the surfaces and the difficulty in removing the paper backer 12 it is very hard on the workers hands. This is especially true given the fact that the operation must be performed outdoors, often inclement weather, and must be performed hours on end.

In view of the sheer number of markers 10 involved, where applying the markers 10 for a single project can take days to complete, one worker cannot remove paper backer 12 for very long without injury or discomfort. Thus, multiple workers are required just to afford workers some relief from the process.

Furthermore, often the actual application of the pavement markers 10 to the roadway is accomplished by a mechanical device, such as a wheel 14 (described in greater detail below), which can apply the markers 10 at a relatively high rate of speed. As a result, removing the paper backer 12 is usually the limiting step in operation since it cannot be accomplished fast enough, and/or requires several people to keep up with the applicator wheel 14.

Accordingly, a need exists for an improved apparatus and method for removing paper backer 12 from pavement markers 10 during the application process that reduces the time it takes to perform the task and reduces the wear and tear on workers.

SUMMARY OF THE INVENTION

An object of the present invention is to provide an apparatus and method for removing paper backer from pavement markers during the application process that substantially eliminates the problems of the prior art.

These and other objects of the present invention will become apparent to those skilled in the art upon reference to the following specification, drawings, and claims. To that end, the present invention comprises a peeler apparatus for mechanical separation of paper backer from the adhesive surface of the markers during the process of applying the markers to a roadway surface.

DETAILED DESCRIPTION OF THE PREFERRED EMBODIMENTS

Figure 1:
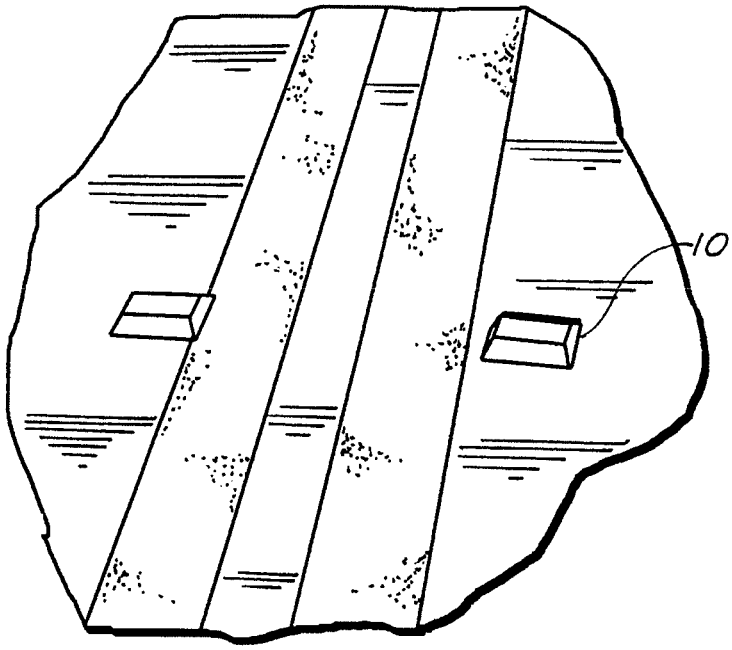
FIG. 1 shows pavement markers applied to a paved road surface.
Figure 2:
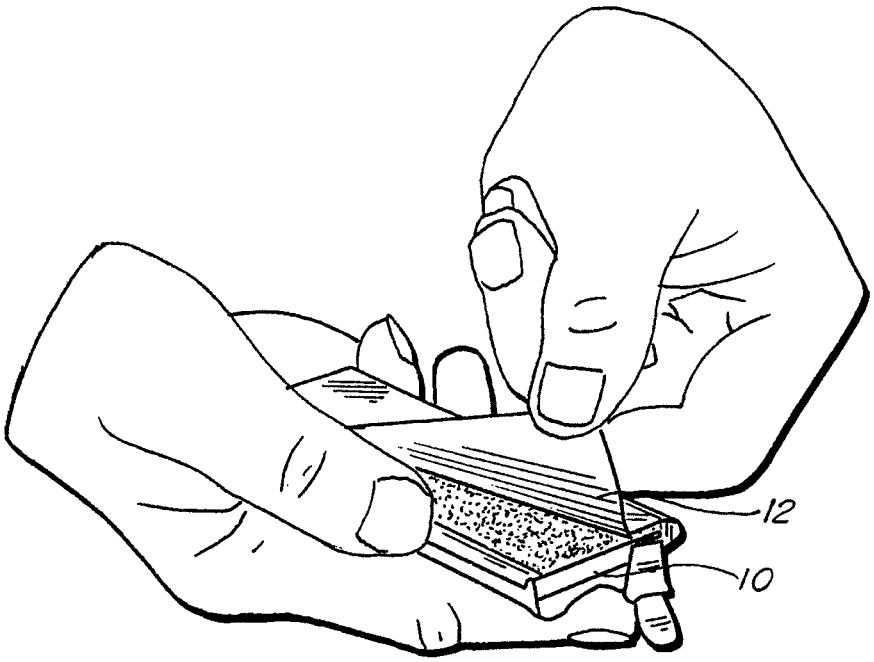
FIG. 2 shows a pavement marker with partially removed paper backer.

In the Figures, is shown an apparatus 16 and method for applying pavement markers 10 to a roadway or other surface. In particular, the apparatus 10 and method automates the step of removing the backing paper 12 from the pavement marker 10 in a fast, efficient, and safe manner that does not subject the workers to repetitive stress and exposure.

Figure 3:
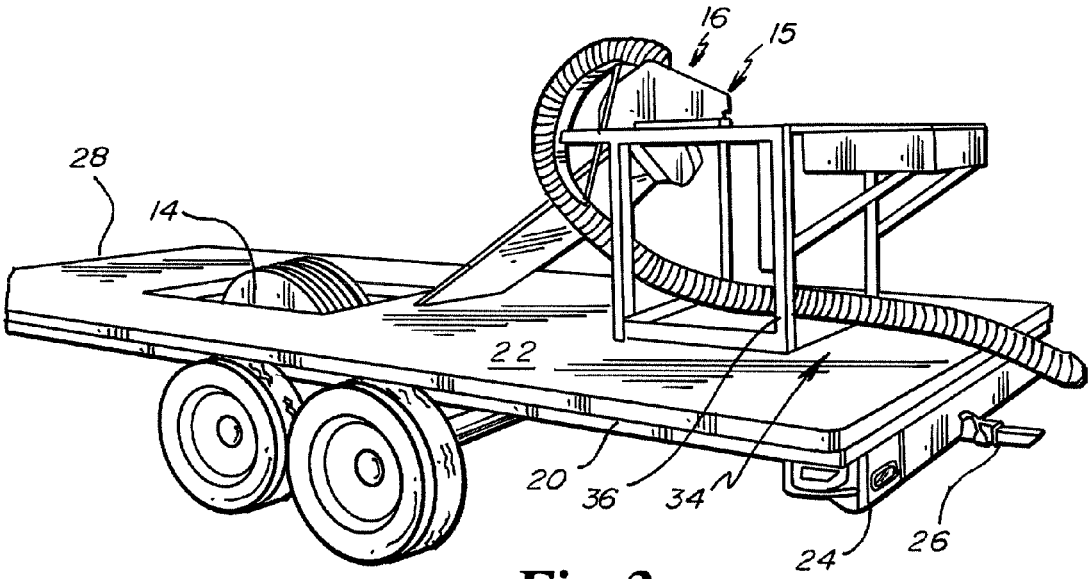
FIG. 3 shows a trailer and mounted peeler apparatus.

FIG. 3 shows the apparatus 14 for applying pavement markers 10 to a roadway or surface. The apparatus 16 includes an automated peeler 18. The peeler 18 is mounted to a trailer 20 that when towed behind a vehicle carries out the method and operation of adhering the markers 10 to a roadway. The peeler 16 is mounted to the deck 22 of the trailer 20 toward the rearward end 24 of the trailer 20, adjacent to a secondary trailer hitch 26. The forward end 28 of the trailer is adapted to be hitched to a towing vehicle, which will tow the trailer 20 and a secondary trailer 30.

Figure 4:
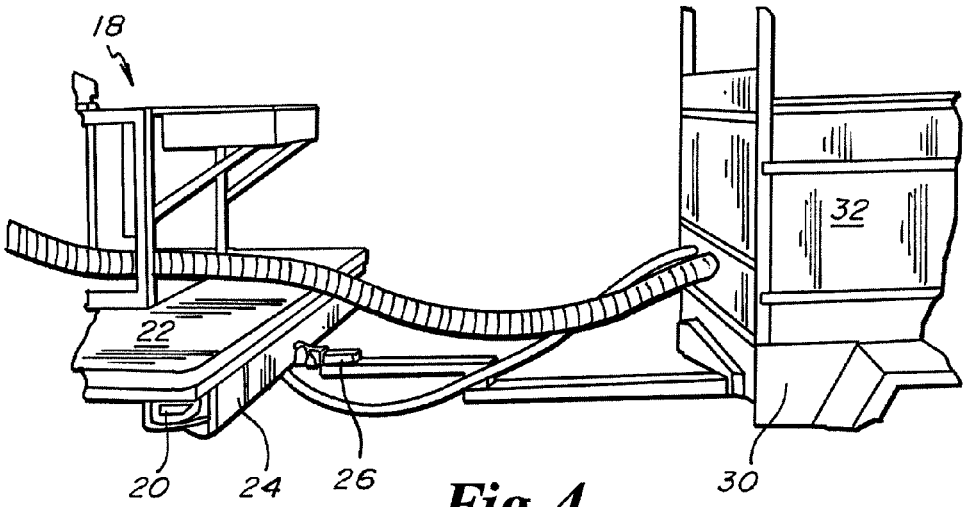
FIG. 4 shows the trailer coupled to an arrow board/signage trailer that contains a generator for powering the automated peeler and vacuum that collects the paper backer after removal from the markers by the peeler.

The trailer 20 is connected at the rearward end 24 to a secondary trailer 30 that houses a container 32 for receipt of the paper backer 12, as disclosed in more detail in FIG. 4. The secondary trailer 30 also includes a generator (not shown—housed within the container 32) for powering the automated peeler 18 and providing vacuum. Soundproofing such as foam is provided around the generator to reduce operational noise. Reflective or powered lighting is included on the back of the secondary trailer 30 to alert traffic of the presence of the trailers/apparatus 16 for safety purposes.

Figure 5:
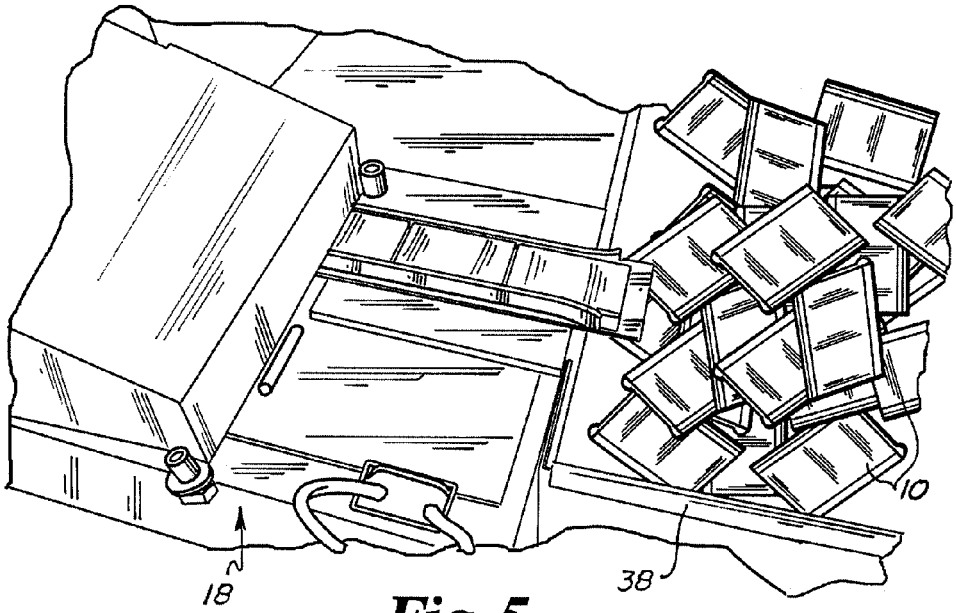
FIG. 5 shows the input chute and storage bin of the peeler.

The peeler 18 is mounted to the deck 22 of the trailer 20 with a frame 34 comprised of four legs 36 and supporting structure. At the rearward end 24 of the peeler (the end adjacent to the secondary trailer 30), a bin 38 is mounted to the peeler 18. The bin 38, as shown in FIG. 5 stores a supply of unprocessed pavement markers 10. The markers 10 in the bin 38 include the paper backer 12 adhered to the butyl adhesive layer on the back (or pavement side) of the marker 10. The bin 38 stores markers to be processed by the peeler 18.

The peeler 18 further comprises an input chute 40, as shown in FIG. 5, which is loaded with markers 10 with the paper backer 12 pavement side up. The markers 10 are placed in the chute and then fed into the peeler 18.

Figure 6:
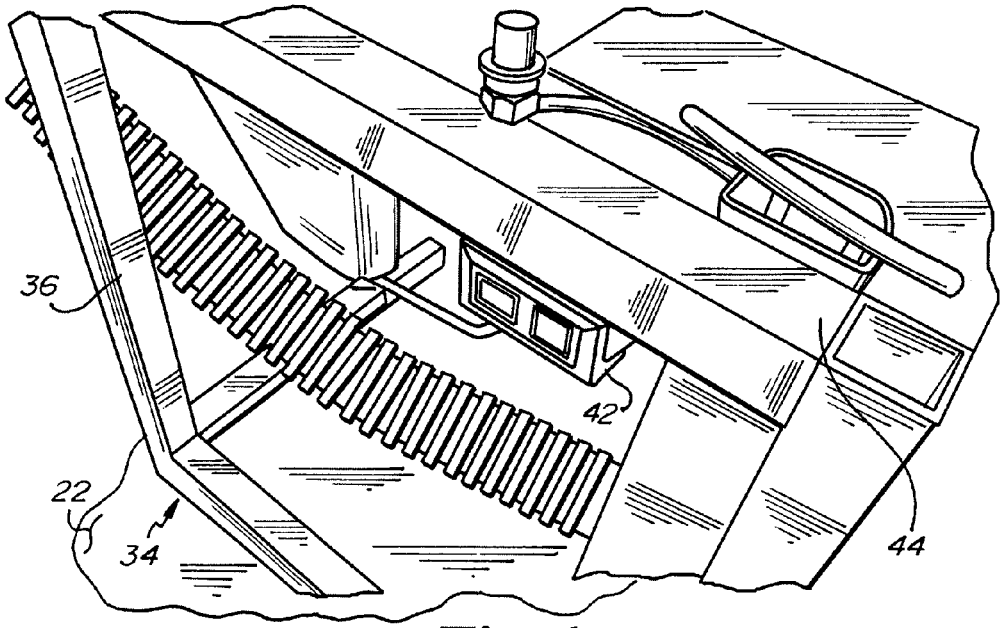
FIG. 6 shows the peeler frame and on/off power switch of the peeler.

Referring to FIG. 6, the peeler 18, which generally is electrically operated and includes an off/on switch 42. The switch 42 provides power to the peeler 18 but does not engage the drive mechanism (described in detail below) of the peeler 18. A person of ordinary skill in the art will understand that the peeler 18 need not be electrically powered, but could be powered by other conventional means such as by battery, pneumatically, gas powered, and the like. FIG. 6 also shows additional members of the frame 34 of the peeler 18. The frame 34 is comprised of four downwardly depending legs 36 secured at the bottom to the trailer deck by a plurality of horizontal supports 44 that form a horizontally oriented square that supports the peeler 18 and the upper ends of the legs 36. The frame 34 also includes a plurality of deck supports that form a horizontally oriented base connected to the lower end of the legs 36.

Figure 7:
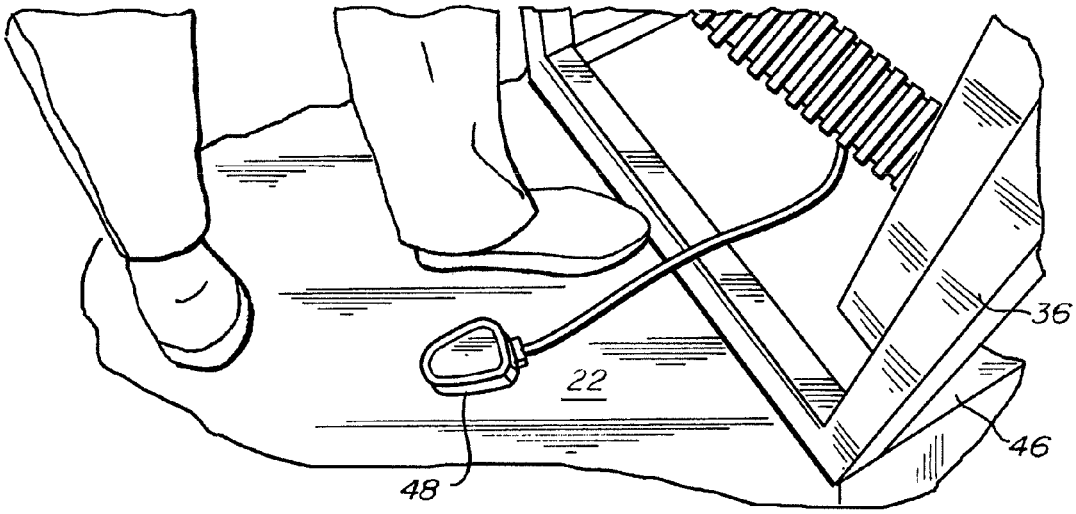
FIG. 7 shows a foot peddle of the peeler apparatus.

The peeler 18 drive mechanism is engaged and disengaged by a foot pedal 48, as shown in FIG. 7, which allows an operator to operate the peeler 18 without hands and easily disengages the peeler 18 in the case of emergency or injury to the operator.

Figure 8:
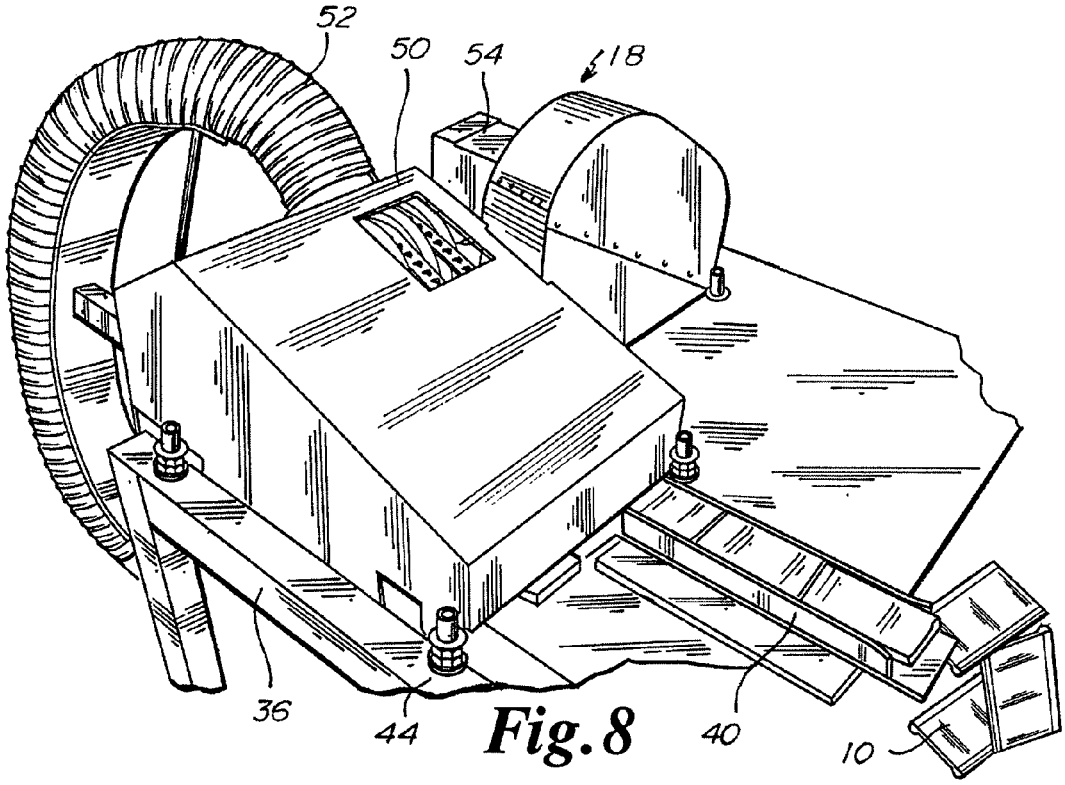
FIG. 8 shows the upper surface of the peeler apparatus including the vacuum shroud.
Figure 11:
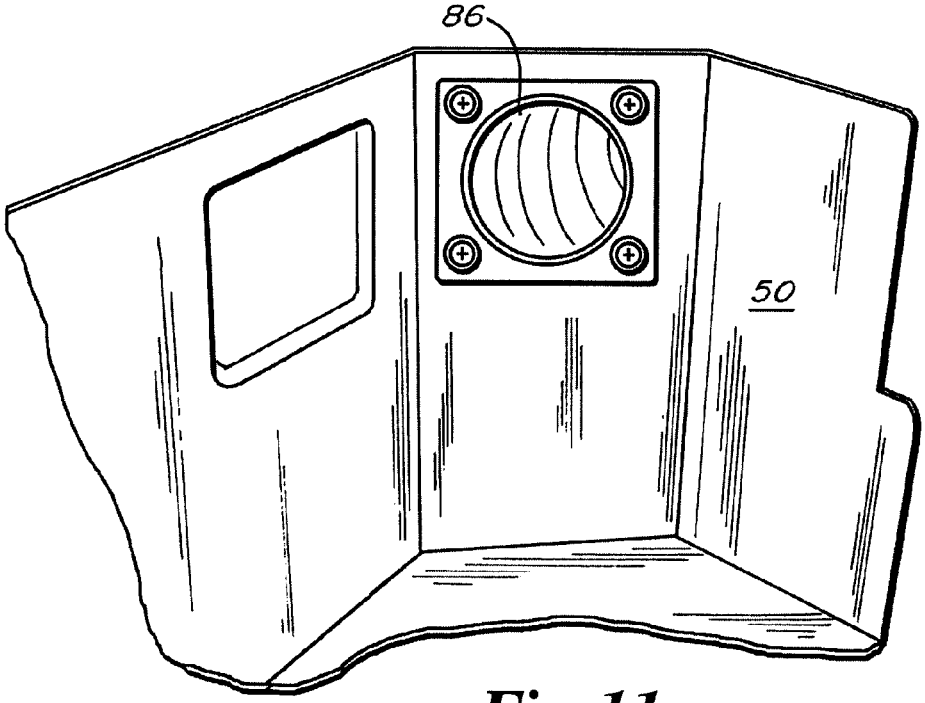
FIG. 11 shows the inside of the vacuum port of the shroud of the peeler.

As best shown in FIG. 8 and FIG. 11, the peeler 18 also includes a shroud 50 with a vacuum hose 52 attached thereto. As explained below, the vacuum hose 52 is used in connection with a motor 54 to create suction to remove the displaced paper backing 12 and transfer it to the container 30 coupled to the rear of the trailer 20 on the secondary trailer 30. The vacuum hose 52 runs from the shroud to the container 30, which stores the paper backing 12 in a removable dispenser as well as houses the vacuum motor.

Figure 9A:
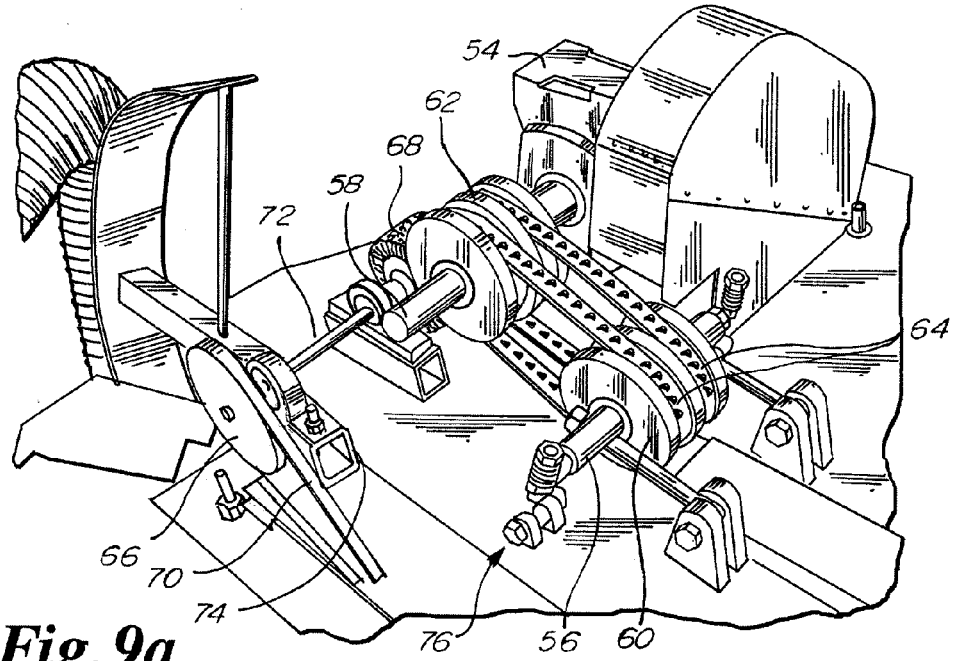
FIG. 9 (*a, b*) shows the peeler apparatus with the vacuum shroud removed, having both a dual and single band configuration.
Figure 9B:
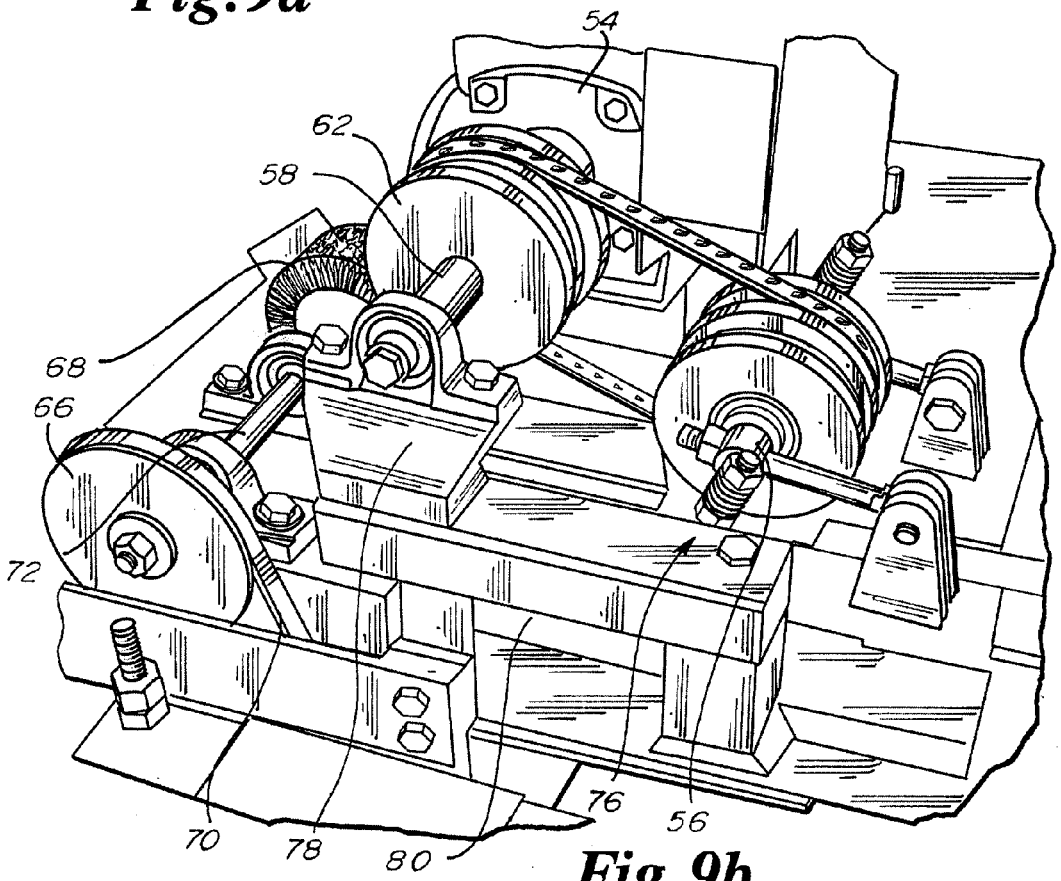

FIGS. 9*a* and 9*b* show the peeler 18 apparatus with the shroud 52 removed. The apparatus 16 comprises two motors. The first motor 54 drives two shafts 56, 58 that turn two drums 60, 62. In particular, the second drum 62 is driven by the second shaft 58 which is driven directly by the motor 54, while the first drum 60 (idler drum) is driven by the first shaft 56 which is driven by the barbed bands 64 connecting the two drums 60, 62. The second motor (located just under the peeler 18 on the opposite side of the peeler 18 from the first motor 54) drives a rotating brush 68. The second rotates the brush 68 by turning a wheel 66, which drives the brush shaft 72 via a belt 70 connected to the motor. The position of second motor, along with the wheel 66 and belt 70, is adjustable to move the brush 68 to ensure that it is properly positioned through movement of a bracket 74. Anchors and linking arms 76 secure the shafts 56, 58 to the peeler 18 as shown in FIGS. 9*a* and 9*b*. Furthermore, as shown in FIGS. 9*a* and 9*b* the apparatus 16 can be configured with one or two barbed bands 64.

As shown in FIG. 9*b* the second shaft 58 that drives the drum 62 is supported on the side opposite to the drive motor 54 with a bearing block 78. This prevents flexing of the shaft 58 that can cause the barbed bands 64 to stretch. The bearing block 78 is mounted to a pivoting arm 80 that can swing the bearing block 78 away from the shaft 58 for maintenance and repair purposes.

Figure 10:
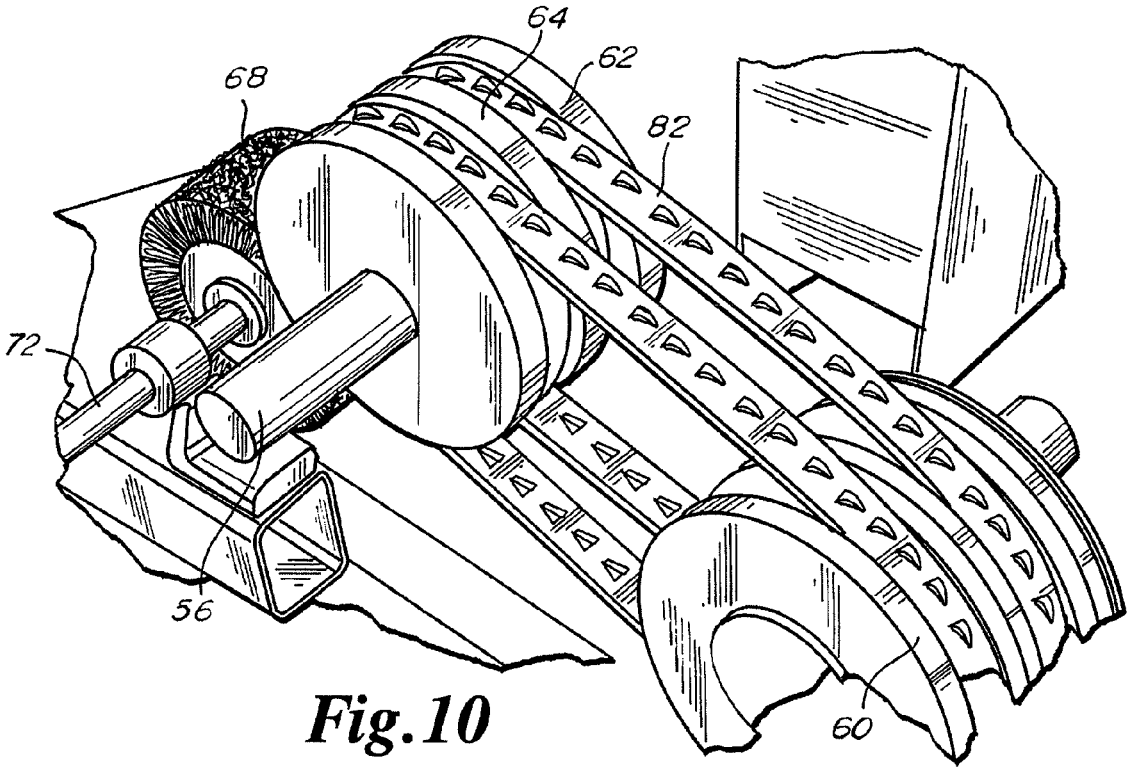
FIG. 10 shows a close up view of the drive drums and barbed bands of the peeler.

As best seen in FIG. 10, the drums 60, 62 include two parallel bands 64 with a plurality of spaced apart barbs 82. The two drums 60, 62 rotate in a clockwise direction (as viewed from FIG. 10). When the pavement markers 10 contact the band 64, barbs 82, and drums 60, 62, the markers 10 are driven toward the forward end 28 of the deck 22. The barbs 82 embed into the paper backer 12 and separate the paper backer 12 from the pavement markers 10. The first drum 60 that the markers 10 encounter is in contact with the markers 10, which both embeds the barbs 82 in the paper backer 12 and drives the markers 10 forward along the maker guide track 84 toward the second drum 62, the second drum 62 is slightly elevated relative to the first drum 60 and the marker guide track 84 which causes the paper backer 12, now grasped by the barbs 82, to lift and separate from the markers 10.

Figure 13:
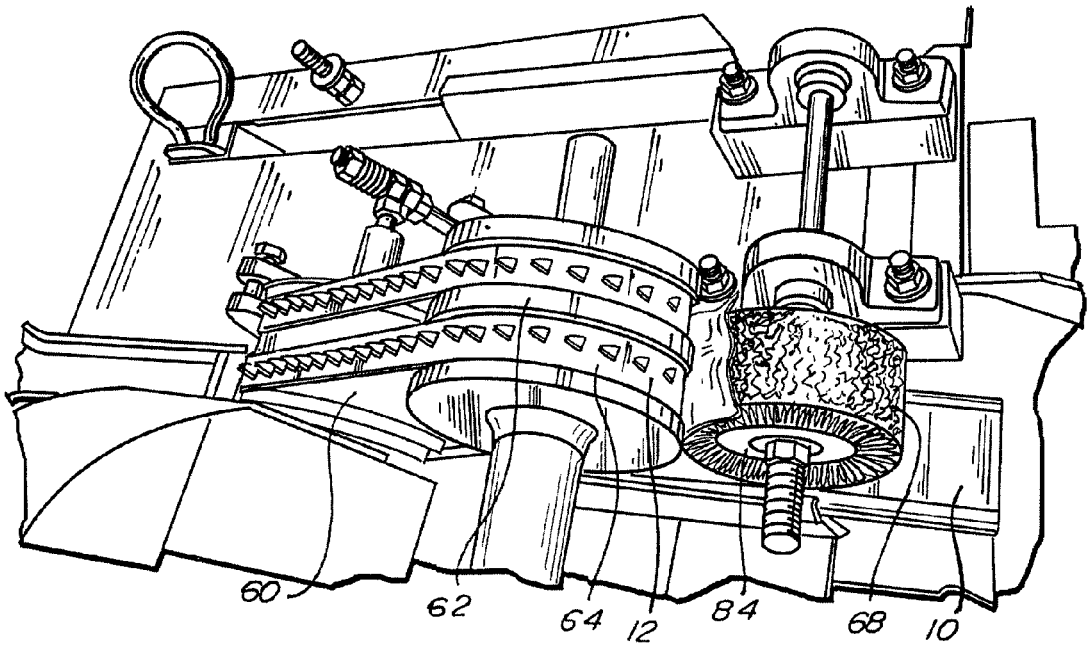
FIG. 13 shows an operational view of the drums and wire bush during separation of paper backer from a marker.

The wire brush 68 which rotates in a counter clockwise direction (as seen in FIG. 10) cleans the barbed bands 82 while it removes the paper backer 12 after the barbed bands 64 have lifted the paper backer 12 from the marker 10 as best seen in FIG. 13. As seen in FIG. 13, which shows the peeler 18 in operation, the paper backer 12 is ejected from between the second drum 62 and the brush 68. The paper backer 12 is then sucked into a vacuum port 86 of the shroud 50 as shown in FIG. 11, into the vacuum hose 52, and into the container 30—thus, completing the separation of the paper backer 12 from the pavement markers 10.

Figure 12:
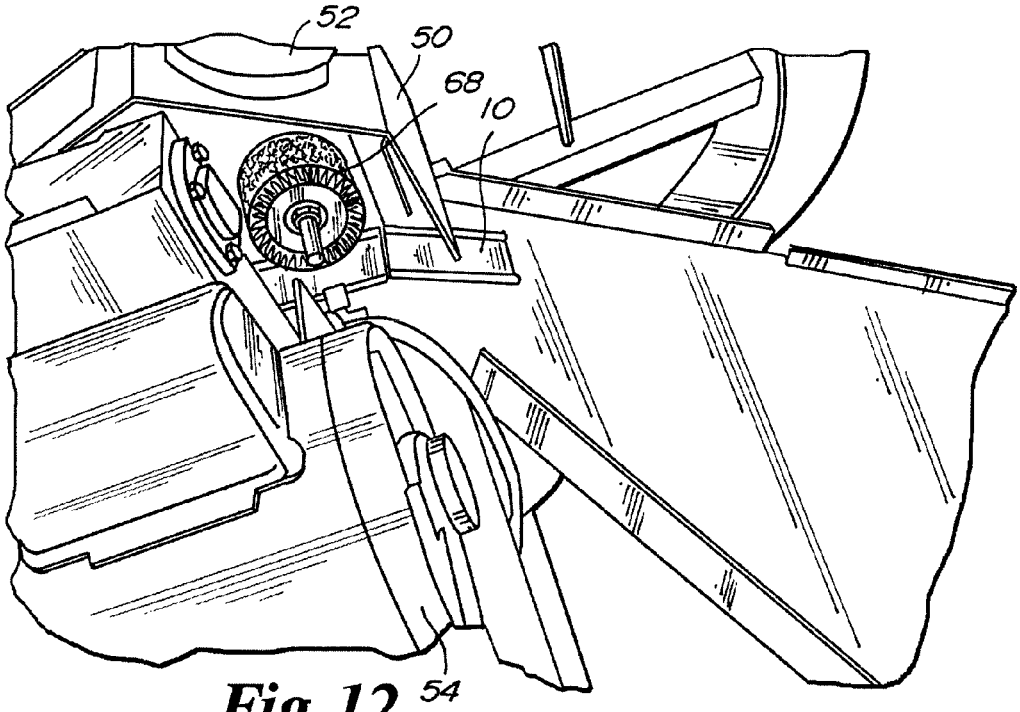
FIG. 12 shows the output end of the peeler apparatus and the top of the exit slide.

FIG. 12 shows the peeler 18 from the opposite side as viewed in the FIGS. 8, 9*a*, 9*b*, and 10. The markers 10 are shown leaving the peeler 18 with the paper backer 12 removed. The markers 10 then descend into a collection area at the bottom of a slide 88 where they are ready to be applied to the road surface.

Figure 14:
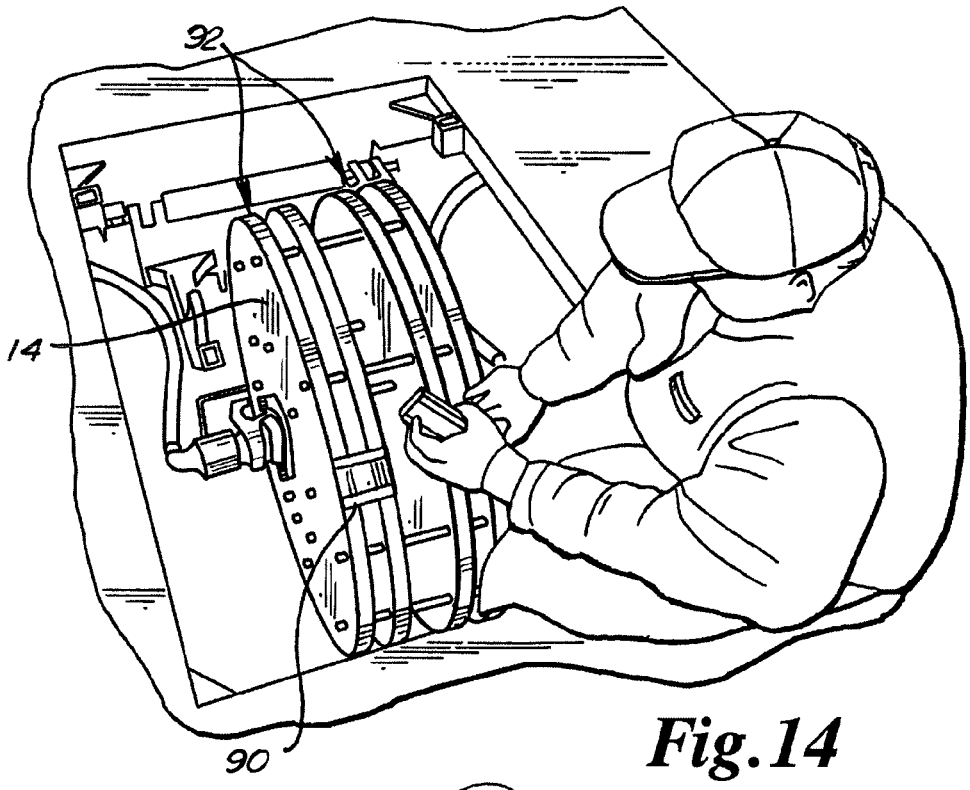
FIG. 14 shows application of the markers to a wheel.

As shown best in FIG. 14 and FIG. 3, as the markers 10 move from the peeler 18 and collect at the base of the slide 88, a worker places the markers 10 into slots 90 located in the wheel 14.

Figure 15:
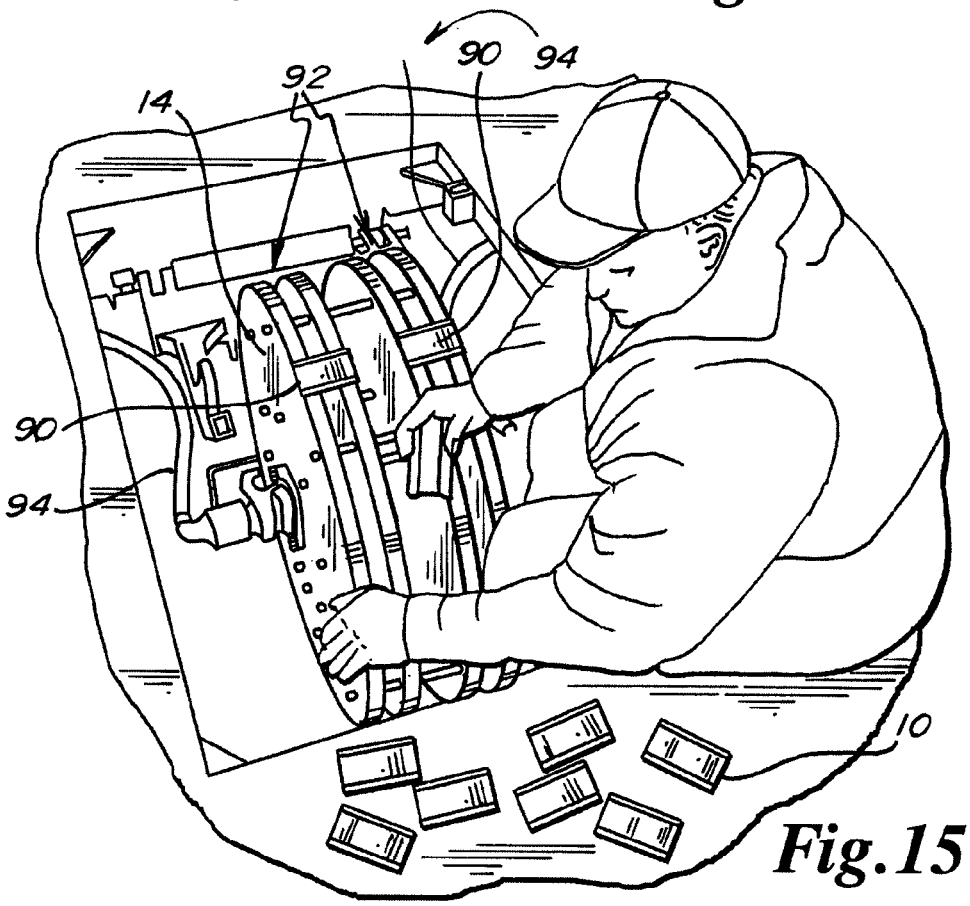
FIG. 15 shows the markers applied to the wheel.

The wheel 14 is comprised of two parallel tracks 92, which include side-by-side slots 90 into which the markers 10 are placed. The markers 10 are placed on the slots 90 with the butyl side up, in side-by-side fashion, as shown in FIG. 15. The markers 10 are held in place by the slots 10 themselves and as well by vacuum suction. Vacuum hoses 94 are attached to each side of the wheel 14 and at the center or axis of the wheel 14. Vacuum is applied to the slots through sealed internal channels leading to the slots 90.

Figure 16:
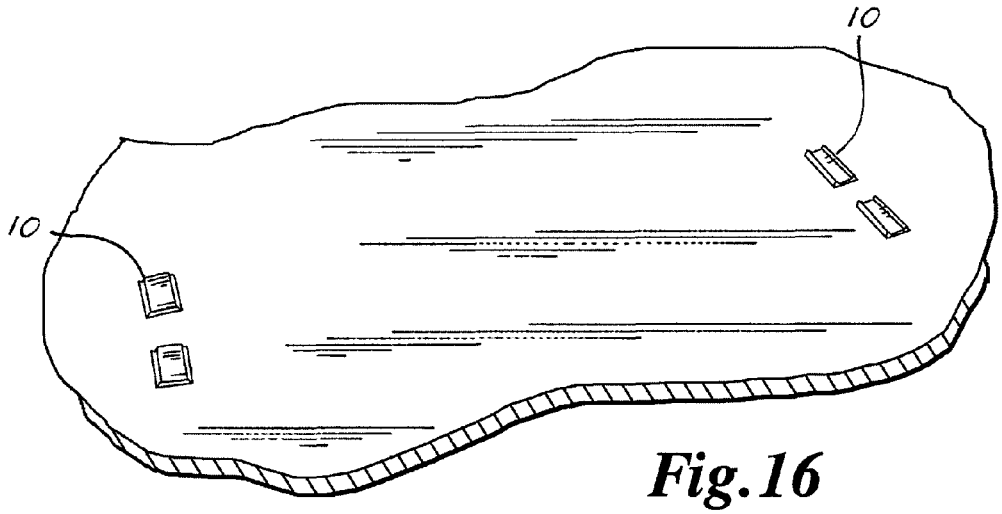
FIG. 16 shows the markers applied to a surface.

As the trailer 20 is towed forward by a towing vehicle, the wheel 14, which is in contact with the road surface, rotates the markers 10 in the slots 90 from the loading position toward the road surface. As the markers 10 reach the road surface, they are pressed into the surface by the wheel 14 adhering the butyl to the surface breaking the vacuum and leaving the markers 10 on the roadway as show in FIG. 16.

Figure 17:
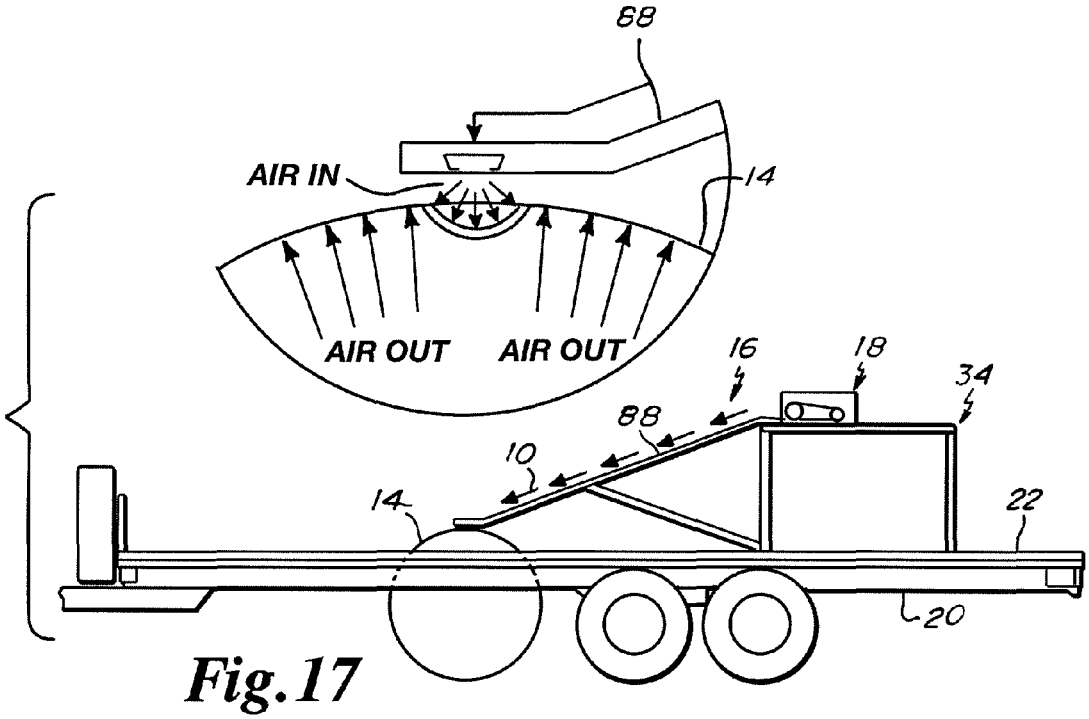
FIG. 17 is a side view of an apparatus that automatically feeds markers to the applicator wheel.

FIG. 17 shows an additional embodiment of the apparatus 16, in which the markers 10 are applied to the road surface mechanically without the intervention of a worker. The markers 10 travel down a slide 88 that feeds them to the wheel 14. The wheel 14 includes a plurality of positive pressure air ports that exert outward air pressure that prevents the markers 10 from adhering to the wheel. The slots 90 apply vacuum pressure to pull the makers 10 through a hole in the slide 88 and into the slots 90 for application to the road surface. The markers 10 are suspended above the wheel 14 by the positive air flow and are restricted from moving by a stop at the end of the slide 88. Then when the markers 10 encounter the vacuum the markers 10 pass through a window in bottom of the end of the slide 88 and are retained in the slots 90 of the wheel 14. They then travel 180 degrees around from the top of the wheel 14 to the road surface and are then applied thereto.

In this manner, the apparatus 16 of the present invention substantially overcomes the limitations of the prior art. The apparatus 16 automatically removes the backing paper 12 from the marker 10 without the need for human contact. A single worker can load the markers 10 into the peeler from the bin 38, and using the foot peddle 48 can control the movement of the markers 10 through the peeler 18. The same, or another worker, can then load a supply of markers 10 into the collection area at the base of the slide 88 and then place them into the slots 90 of the wheel 14 while the trailer 20 is moving forward, or this can be automatically accomplished as show in FIG. 17. This allows for continuous operation and application of the markers 10 to the road surface, with a reduced number of workers and reduces the exposure of the workers to repetitive stress of prior art systems that require manual separation of the paper backer 12 from the pavement markers 10.

While the preferred embodiment of the invention has been described in reference to the markers shown in the Figures, the invention is not so limited. The invention can be adapted to use different types of pavement markers 10 including, raised pavement markers (RPMs), temporary pavement markers (TPMs), temporary overlay markers, temporary chip seal markers, and the like. In the case of L-shaped markers, such as chip seal markers, the apparatus would require modification to provide for a slot in the input chute and extending through the peeler to accommodate the upward extending portion of the marker.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods, and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention. For example, the loading of the markers into the bin may be automated by suitable mechanical means. The loading of the markers from the collection area at the base of the slide onto the slots of the wheel can also be automated. Further, the container that houses the separated paper backer need not be located on a separate trailer, but could be located on the same trailer as the peeler. In addition, the invention can be adapted to the separation of articles other than paper backer from pavement markers.

The invention claimed is:

1. An apparatus for separation of backer paper from pavement markers for application thereof to a roadway or surface, comprising:

an input chute for feeding the markers into the apparatus; and a rotating drum for engaging and removing the backer paper from the marker.

2. The apparatus of claim 1 further comprising a barbed band engaged with said drum for grasping the surface of the backer paper.

3. The apparatus of claim 2 wherein said drum is a first drum, and further comprising a second drum wherein the barbed band is engaged with both drums.

4. The apparatus of claim 2 further comprising a motor driving the drums.

5. The apparatus of claim 3 wherein said second drum is positioned behind and above the first drum relative to the path of the markers.

6. The apparatus of claim 5 further comprising a brush for removing the backer paper.

7. The apparatus of claim 6 wherein the brush is rotating in the opposite direction as the drums.

8. The apparatus of claim 6 wherein the brush is driven by a motor.

9. The apparatus of claim 5 wherein the brush is movable to allow for adjustment of its position.

10. The apparatus of claim 1 comprising a vacuum port and hose for removal of the backer paper.

11. The apparatus of claim 10 comprising a container for deposit of the backer paper.

12. The apparatus of claim 1 comprising a trailer for mounting the apparatus.

13. The apparatus of claim 1 further comprising a wheel for applying the markers to the road after removal of the backer paper.

14. The apparatus of claim 13 wherein the wheel comprises two tracks for applying two rows of markers.

15. The apparatus of claim 13 wherein the markers are retained in slots on the wheel with vacuum pressure.

16. The apparatus of claim 15 comprising a slide for placing the markers above the slots to be received in the slots by vacuum pressure.

17. The apparatus of claim 3 comprising two barbed bands.

18. The apparatus of claim 3 wherein one of the drums is mounted on a movable bearing block.

* * * * *